US005576514A

United States Patent [19]

Fujimoto et al.

[11] Patent Number: 5,576,514

[45] Date of Patent: Nov. 19, 1996

[54] COIL TYPE HIGH-VOLTAGE RESISTIVE CABLE FOR PREVENTING NOISE

[75] Inventors: Terutsugu Fujimoto; Makoto Higashikozono; Hiroshi Inoue, all of Yokkaichi, Japan

[73] Assignee: Sumitomo Wiring Systems, Ltd., Japan

[21] Appl. No.: 420,295

[22] Filed: Apr. 11, 1995

[30] Foreign Application Priority Data

Jun. 30, 1994 [JP] Japan ..... 6-148900

[51] Int. Cl.[6] ..... H01B 7/02

[52] U.S. Cl. ..... 174/110 R; 174/110 FC; 174/120 SC; 338/214

[58] Field of Search ..... 174/110 R, 110 FC, 174/110 PM, 120 SC, 122 R, 122 G, 36; 338/214

[56] References Cited

U.S. PATENT DOCUMENTS

| | | | |
|---|---|---|---|
| 3,191,132 | 6/1965 | Mayer | 333/79 |
| 3,683,309 | 8/1972 | Hirose | 338/214 |
| 4,301,428 | 11/1981 | Mayer | 333/12 |
| 4,435,692 | 3/1984 | Miyamoto et al. | 338/214 |
| 4,800,359 | 1/1989 | Yukawa et al. | 338/214 |
| 4,970,488 | 11/1990 | Horiike et al. | 338/214 |
| 5,057,812 | 10/1991 | Yukawa et al. | 338/66 |

FOREIGN PATENT DOCUMENTS

| | | | |
|---|---|---|---|
| 1333494 | 3/1994 | Canada . | |
| 2593329 | 7/1987 | France | 174/36 |
| 1-9287 | 4/1989 | Japan . | |

*Primary Examiner*—Kristine L. Kincaid
*Assistant Examiner*—Marc D. Machtinger
*Attorney, Agent, or Firm*—Anthony J. Casella; Gerald E. Hespos

[57] ABSTRACT

In order to provide a coil type high-voltage resistive wire having a lower resistance than and a noise preventing performance similar to a prior art resistive wire while maintaining an inductance level without increasing a diameter and a winding pitch of a resistance wire, a core (3) consists essentially of a center reinforcing core (1) which is obtained by twisting three aramid fibers of 1000 denier and a ferrite core (2) having an outer diameter of 1.3 mm or smaller which is obtained by extruding a mixture of resin or rubber base and ferrite powder around the center reinforcing core (1). A resistance wire 5 made of a copper-nickel alloy wire having a diameter of 35 to 55 μm and an electrical resistivity of 5 to 35 μΩ.cm is wound around the core 3 at a pitch of 10000 winds/m or larger in a direction normal to the longitudinal axis of the core (3), so that the resistance value of the resistance wire (5) as a conductor can be set at 4 to 7 kΩ/m. An insulator layer (6) having an outer diameter of 4.6 mm or smaller is formed over the resistance wire (5). A reinforcing net (7) of glass fibers and a sheath (8) having an outer diameter of 7 mm are formed in this order around the insulator layer (6).

6 Claims, 2 Drawing Sheets

COIL TYPE HIGH-VOLTAGE RESISTIVE CABLE FOR PREVENTING NOISE

BACKGROUND OF THE INVENTION

1. Field of the Invention

The present invention relates to a coil type high-voltage resistive cable for preventing noise, in which cable the outer surface of a core is wound with a resistance wire having a specified electrical resistivity, in a direction normal to the longitudinal axis of the core, and then coated with an insulator layer.

2. Description of the Prior Art

A high-voltage generated in an ignition coil is applied by way of a distributor or directly to a spark plug. In view of this, there have been used two types of high-voltage resistive cables for connecting the ignition coil and the spark plug: braid type obtained by twisting fibers impregnated with carbon; and coil type obtained by winding a thin metal wire having a high electrical resistivity around a core of magnetic material, etc. High-voltage resistive cables of both types are required to have a low transmission loss, excellent heat and voltage resistances and to display a good noise preventing effect against noises resulting from spark ignition of an engine.

Wires disclosed in, e.g., Japanese Examined Utility Model Publications Nos. 1-32253 and 6-6418 are known as prior art coil type high voltage resistive cables for preventing noise.

Specifically, the coil type high voltage resistive cable disclosed in the former publication is as follows. A mixture obtained by mixing 300 to 700 parts by weight of ferrite powder with 100 parts by weight of base polymer is extruded to coat a center reinforced braid obtained by twisting aramid fibers, thereby obtaining a ferrite core having an outer diameter of 1.3 mm or smaller. A resistance wire is wound around the outer surface of the ferrite core at a pitch of 8000 to 14000 winds/m in a direction normal to the longitudinal axis of the ferrite core. Polyolefin resin is extruded to coat the outer surface of the ferrite core wound with the resistance wire, thereby forming an insulator layer. Further, a sheath is formed around the outer surface of the insulator layer. As a specific example, this publication discloses: the outer surface of aramid fibers of 1500 denier is coated with the mixture obtained by mixing Mn-Zn ferrite powder with chlorinated polyethylene, and a nichrome (Ni-Cr) wire having a diameter of 0.06 mm and an electrical resistivity of 105 μΩ.cm is wound around the outer surface of the ferrite core at a pitch of 9600 winds/m to set the resistance value of the entire resistance wire as a conductor at 16 kΩ/m.

On the other hand, the coil type high-voltage resistive cable disclosed in the latter publication is as follows. Silicon rubber mixed with ferrite powder is extruded to coat a tension member consisting essentially of aramid fibers, thereby forming a core. A stainless wire or like resistance wire having a diameter of 0.055 mm is wound around the outer surface of the core at a pitch of 14000 winds/m. A partially conductive resin layer having a uniform thickness of 4 to 8 μm and an electrical resistivity of $10^2$ to $10^5$ Ω.cm is formed on the core wound with the resistance wire, for example, by dipping this core in molten epoxy resin mixed with carbon.

There has been developed a so-called lean-burn engine for burning lean fuel mixture in view of an exhaust gas control for automotive vehicles which will be enforced as a countermeasure to the environmental problems in recent years. Such an engine is required to have a higher ignition energy than normal engines, thus making it necessary to reduce a resistance value of the aforementioned coil type high-voltage resistive cable used to connect the ignition coil and the spark plug, for example, to ½ of that of the prior art resistive cable.

However, in the case of the above coil type high-voltage resistive cable for preventing noise, if the winding pitch of the resistance wire is reduced in order to lower the resistance value of the resistive cable, the inductance of the resistive cable becomes smaller, resulting in a reduced noise preventing effect. In order to avoid this, the resistance value of the resistive cable may be reduced by using a thicker resistance wire without reducing the winding pitch. In this case, the short-circuiting of the densely wound resistance wire may cause an abnormal reduction in the resistance value and a reduction in the noise preventing performance.

The short-circuiting of the resistance wire normally occurs when a spacing between adjacent winds of the resistance wire is smaller than the diameter of the resistance wire. In order to prevent this short-circuiting, it may be considered to form a partially conductive resin layer on the resistance wire as disclosed in the above publication (Japanese Examined Utility Model Publication No. 6-6418). However, this leads to a higher manufacturing cost and is thus economically disadvantageous.

In view of the above problem, it is an object of the invention to provide a coil type high-voltage resistive cable for preventing noise, which cable has a lower resistance value than and a noise preventing performance substantially similar to a prior art resistive cable while maintaining an inductance level without increasing the diameter of the resistance wire and reducing the winding pitch thereof.

SUMMARY OF THE INVENTION

According to the invention, a reduction in inductance can be prevented without increasing the diameter of the resistance wire and reducing the winding pitch thereof, thereby enabling realization of a coil type high-voltage resistive cable having a lower resistivity than and a noise preventing performance substantially similar to the prior art resistive cable. Such a cable is suited for supplying a voltage to a spark plug of a lean-burn engine which requires a high ignition energy.

Preferably, the core consists essentially of a center reinforcing core which is obtained by twisting three aramid fibers of 1000 denier and a ferrite core having an outer diameter of 1.3 mm or smaller which is obtained by extruding a mixture of resin or rubber base and ferrite powder around the center reinforcing core. It is further preferred that the resistance wire is made of a copper-nickel alloy wire, the insulator layer is a layer of flexible crosslinking polyethylene having an outer diameter of 4.6 mm which is formed over the resistance wire, and/or that a reinforcing net of glass fibers and a sheath having an outer diameter of 7 mm are formed in this order around the insulator layer.

If the core consists essentially of the center reinforced core obtained by twisting three aramid fibers of 1000 denier and the ferrite core, a copper-nickel alloy wire is used as the resistance wire, the insulator layer is of flexible crosslinking polyethylene (PEX) and a reinforcing net of glass fiber and a sheath are formed on the insulator layer, there can be obtained a coil type high-voltage resistive cable having an excellent noise preventing performance which is suited for supplying a voltage to a spark plug of a lean-burn engine.

When a resistance value R of the resistance wire of the coil type high-voltage resistive cable for preventing noise is reduced, a noise preventing performance is reduced if an inductance L is kept constant as is clear from Equation (1) defining a characteristic impedance Z of the cable if an inductance L is kept constant. It is necessary to increase the inductance L in order to avoid this. Here, it should be appreciated that C denotes an electric capacity of the cable and f denotes a frequency of a power supply.

$$Z=\sqrt{R^2+\left(2\pi fL-\frac{1}{2\pi fC}\right)^2} \quad (1)$$

On the other hand, the inductance L is defined in Equation (2), wherein d denotes a diameter of a core, μs denotes a magnetic permeability of the core, and N denotes a winding pitch. From Equation (2), it is seen that an increase in the diameter d of the core leads to an increase in the electric capacity of the cable. Thus, a floating capacity between the cable and an engine body may increase when dew drops are formed on the surface of the cable, i.e., the capacity C may vary over the length of the cable depending upon the presence of dew drops, thereby reducing the voltage of the spark plug. In order to increase the magnetic floating permeability μs, it is necessary to increase, for example, a quantity of ferrite powder. An increase in the quantity of ferrite powder leads to a decrease in strength and elongation of ferrite containing rubber, enabling even a small force to cause a crack in the rubber. The core wound with the resistance wire may disadvantageously be peeled or broken upon a force applied during the processing of the end of the cable. Thus, it is effective to increase the winding pitch N of the resistance wire in order to increase the inductance L.

$$L=4\pi^2\cdot\mu S\cdot N^2\times10^{-7}(H/m) \quad (2)$$

The noise preventing performance was measured while varying the winding pitch according to a so-called current method which is one of the methods for measuring the noise preventing performance by measuring a high frequency current by means of a current probe. As an inventive result of this measurement, it was found out that a winding pitch of 10000 winds/m or larger is necessary to obtain the noise preventing performance similar to or better than the prior art cables.

In order to wind the resistance wire laterally or in a direction normal to the longitudinal axis of the core without forming the partially conductive layer as in the prior art cable, the diameter of the resistance wire is preferably 35 to 55 μm. As described above, in order to obtain the noise preventing performance similar to the prior art cable, the resistance wire needs to be wound at a pitch of 10000 winds/m or larger. An optimal electrical resistivity of the resistance wire to satisfy these conditions was examined and the examination result is shown in FIG. 2.

FIG. 2 shows a variation of electric resistivity in relation to the winding pitch for the respective diameters when the resistance value of the entire resistance wire as a conductor are set at 4 kΩ/m and 7 kΩ/m, respectively (where the diameter of the core is 1.3 mm). Dotted portions in FIG. 2 show regions where the resistance wire cannot be wound laterally of the core because of the short-circuiting thereof. It is seen from FIG. 2 that the electrical resistivity of the resistance wire which can be laterally wound at a pitch of 10000 winds/m or larger is preferably about 5 to 35 μΩm.

TABLE-1 shows electrical resistivities of various materials for the resistance wire and whether or not these materials can be drawn to obtain a resistance wire having a diameter of 35 to 55 μm. It is seen from TABLE-1 that types 2, 3 and 4 of copper-nickel (Cu-Ni) alloy are suitable for the resistance wire material because they have the aforementioned electrical resistivity (5 to 35 μΩ.cm) and can be drawn into a wire having the aforementioned diameter. It will be noted that o and x in TABLE-1 denote that wire drawing is possible and impossible, respectively.

TABLE-1

| RESISTANCE WIRE | COMPONENTS (WEIGHT %) | ELECTRICAL RESISTIVITY (μΩ · cm) | PROCESSABILITY ON DRAWING WIRE |
|---|---|---|---|
| Nichrome No. 1 | 80 Ni, 20 Cr | 108 | o |
| 18/8 Stainless | 8 Ni, 18 Cr, 74 Fe | 70 | o |
| Cu—Ni Type 2 | 23 Ni, 77 Cu | 30 | o |
| Cu—Ni Type 3 | 12 Ni, 88 Cu | 15 | o |
| Cu—Ni Type 4 | 6 Ni, 94 Cu | 10 | o |
| Pure Iron | — | 10 | x |

If the resistance wire made of a Cu-Ni wire having an electrical resistivity of 5 to 35 μΩ.cm is laterally wound around the core at a pitch of 10000 winds/m or larger, the resistance value of the entire resistance wire as a conductor can be set at 4 to 7 kΩ/m which is less than ½ of that of the prior art cables. In this way, a reduction in inductance can be prevented without increasing the diameter of the resistance wire and reducing the winding pitch thereof, thereby enabling realization of a coil type high-voltage resistive cable having a lower resistivity than and a noise preventing performance substantially similar to the prior art resistive cables.

If the core consists essentially of a center reinforced core obtained by twisting three aramid fibers of 1000 denier and a ferrite core, the diameter of the resistance wire is 35 to 55 μm, the insulator layer is of flexible crosslinking polyethylene (PEX), and a reinforcing net of glass fiber and a sheath are formed on the insulator layer, there can be obtained a coil type high-voltage resistive cable having an excellent noise preventing performance which is suited for supplying a voltage to a spark plug of a lean-burn engine.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Figure 1:
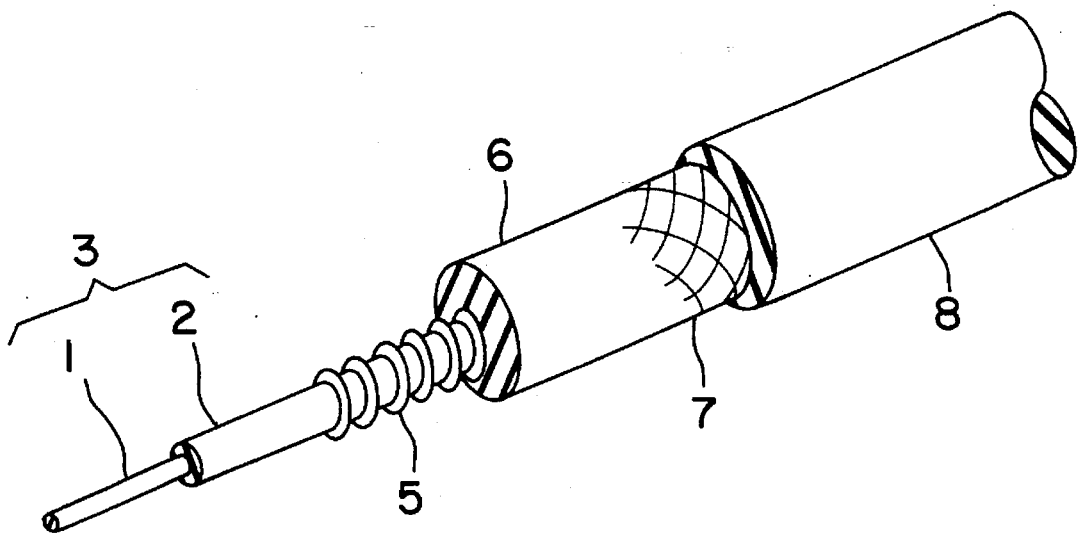
FIG. 1 is a perspective view of one embodiment of the invention.
Figure 2:
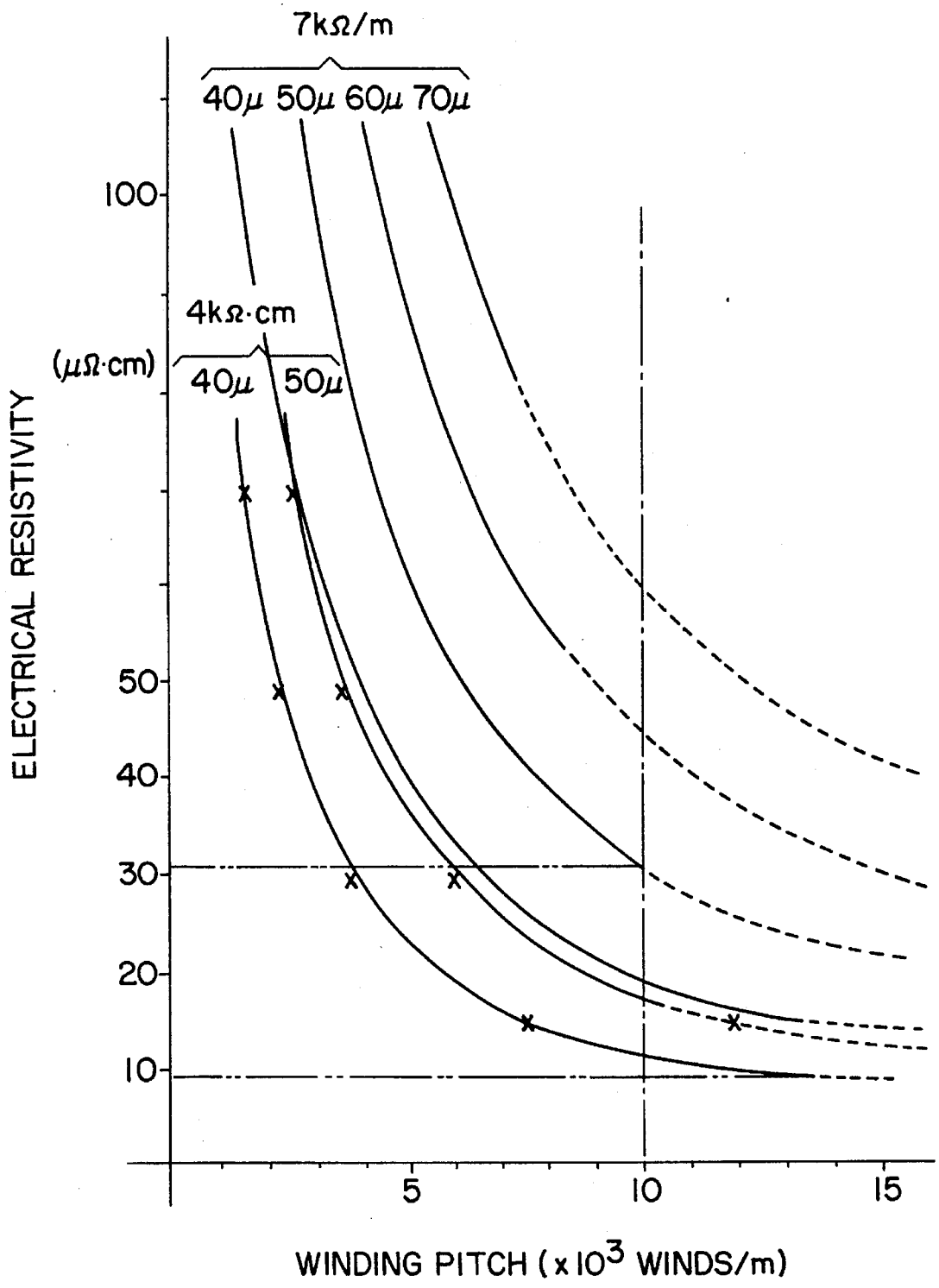
FIG. 2 is a graph showing the electrical resistivity of various resistance wires in relation to the winding pitch.

As shown in FIG. 1, a center reinforcing core 1 is formed by twisting three aramid fibers of 1000 denier. A mixture obtained by kneading fluorine base and ferrite powder is extruded around the center reinforcing core 1 to form a ferrite core 2 having an outer diameter of 1.3 mm or smaller. A core 3 consists of the center reinforcing core 1 and the ferrite core 2.

A resistance wire 5 made of Cu-Ni type 2, 3 or 4 which has a diameter of 35 to 55 μm and an electrical resistivity of 5 to 35 μΩ.cm is laterally wound around the core 3 at a pitch of 10000 winds/m or larger, thereby setting the resistance value of the entire resistance wire 5 as a conductor at 4 to 7 kΩ/m. An insulator layer 6 of flexible crosslinking polyethylene having an outer diameter of 4.6 mm or smaller is formed over the resistance wire 5. A reinforcing net 7 of 24 braided glass fibers and a sheath 8 of EPDM (ethylene-propylene terpolymer) or silicone having an outer diameter of 7 mm are formed around the insulator layer 6.

A noise current of cables A and B with the respective frequencies of 45, 90 and 180 MHz was measured and comparison results with a prior art cable are shown in TABLE 2. In the cable A, a wire of Cu-Ni type 2 having a diameter of 50 μm is used as the resistance wire 5 and is laterally wound at a pitch of 10000 winds/m to set a conductor resistance value at 7 kΩ/m. In the cable B, a wire of Cu-Ni type 4 having a diameter of 40 μm is used as the resistance wire 5 and is laterally wound at a pitch of 11000 winds/m to set a conductor resistance value at 4 kΩ/m. In the prior art cable, a nichrome wire having a diameter of 50 μm is laterally wound at a pitch of 7000 winds/m around a core consisting of a center reinforcing core obtained by twisting three aramid fibers of 1000 denier and a ferrite core having an outer diameter of 1.3 mm, thereby setting a conductor resistance value at 16 kΩ/m.

TABLE-2

| | NOISE CURRENT (dBμA) | | |
|---|---|---|---|
| CABLE A (Cu—Ni type 2) | 34 | 20 | 6 |
| CABLE B (Cu—Ni type 4) | 24 | 10 | 3 |
| PRIOR ART CABLE | 38 | 24 | 10 |
| FREQUENCY (MHz) | 45 | 90 | 180 |

Thus, according to this embodiment, a reduction in inductance can be prevented without increasing the diameter of the resistance wire 5 and reducing the winding pitch, thereby enabling realization of a coil type high-voltage resistive cable having a lower resistivity than and a noise preventing performance substantially similar to the prior art resistive cable. Such a cable is suited for supplying a voltage to a spark plug of a lean-burn engine which requires high ignition energy.

It should be appreciated that material for the resistance wire is not limited to the aforementioned types of Cu-Ni alloy. Any material may be used as long as a resistance wire which has an electrical resistivity of 5 to 35 μΩ.cm and a diameter of 35 to 55 μm and can be laterally wound around the core at a pitch of 10000 winds/m or larger can be made thereof.

What is claimed is:

1. A coil type high-voltage resistive cable for preventing noise comprising a resistance wire (5) wound around a core (3) in a direction normal to the longitudinal axis of the core (3) and an insulator layer (6) formed around the core (3) wound with the resistance wire (5), wherein the diameter and electrical resistivity of the resistance wire (5) is 35 to 55 μm and 5 to 35 μΩ.cm, respectively, and the resistance wire (5) is wound around the core (3) at a pitch of at least 10000 turns/m, so that the resistance value of the wound resistance wire as a conductor can be set at 4 to 7 kΩ/m.

2. A cable according to claim 1, wherein:

the core (3) consists of a center reinforcing core (1) which is obtained by twisting three aramid fibers of 1000 denier and a ferrite core (2) having an outer diameter of 1.3 mm or smaller which is obtained by extruding a mixture of resin or rubber base and ferrite powder around the center reinforcing core (1).

3. A cable according to claim 1, wherein the resistance wire (5) is made of a copper-nickel alloy wire.

4. A cable according to claim 1, wherein the insulator layer (6) is a layer of flexible crosslinking polyethylene having an outer diameter of 4.6 mm which is formed over the resistance wire (5).

5. A cable according to claim 4, wherein a reinforcing net (7) of glass fibers and a sheath (8) having an outer diameter of 7 mm are formed in this order around the insulator layer (6).

6. A coil type high-voltage resistive noise-preventing cable for connecting an ignition coil and a spark plug in a lean-burn engine, comprising a resistance wire (5) wound around a core (3) in a direction normal to the longitudinal axis of the core (3) and an insulator layer (6) formed around the core (3) wound with the resistance wire (5), wherein the diameter and electrical resistivity of the resistance wire (5) is 35 to 55 μm and 5 to 35 μΩ.cm, respectively, and the resistance wire (5) is wound around the core (3) at a pitch of at least 10000 turns/m, so that the resistance value of the wound resistance wire as a conductor can be set at 4 to 7 kΩ/m.

* * * * *